US006099977A

United States Patent [19]

Buresch et al.

[11] Patent Number: 6,099,977

[45] Date of Patent: Aug. 8, 2000

[54] STRIP COMPOSITE MATERIAL AND A METHOD AND APPARATUS FOR ITS MANUFACTURE

[75] Inventors: Isabell Buresch, Illertissen; Hermann Sturm, Bellenberg, both of Germany

[73] Assignee: Wieland-Werke AG, Ulm, Germany

[21] Appl. No.: 08/990,606

[22] Filed: Dec. 15, 1997

[30] Foreign Application Priority Data

Dec. 19, 1996 [DE] Germany ..... 196 52 987

[51] Int. Cl.[7] ..... B32B 15/00; H01R 4/58; B05D 1/18; B05D 5/08

[52] U.S. Cl. ..... 428/647; 428/646; 428/647; 428/939; 439/886; 427/383.7; 427/334; 148/537

[58] Field of Search ..... 428/646, 610, 428/647, 634, 648, 939, 935; 439/886, 887; 148/537, 278, 242, 246; 205/225, 234, 235; 427/433, 334, 383.7

[56] References Cited

U.S. PATENT DOCUMENTS

| | | | |
|---|---|---|---|
| 2,721,149 | 10/1955 | Nelson | 117/114 |
| 3,975,216 | 8/1976 | Stayner | 148/23 |
| 4,486,510 | 12/1984 | Tanimoto et al. | 428/598 |
| 5,222,650 | 6/1993 | Lymn | 228/20 |
| 5,395,702 | 3/1995 | Carey, II et al. | 428/624 |
| 5,616,424 | 4/1997 | Carey, II et al. | 428/647 |
| 5,780,172 | 7/1998 | Fister et al. | 428/647 |

FOREIGN PATENT DOCUMENTS

| | | |
|---|---|---|
| 665 447 | 1/1952 | United Kingdom . |
| 665 448 | 1/1952 | United Kingdom . |
| 665 449 | 1/1952 | United Kingdom . |

*Primary Examiner*—John J. Zimmerman
*Attorney, Agent, or Firm*—Flynn, Thiel, Boutell & Tanis, P.C.

[57] ABSTRACT

The invention relates to a strip composite material with a base material of a metal or a metal alloy and a tin coating on the surface, whereby an intermetallic phase (IMP) is formed between the base material and the coating. In particular for achieving good wear and corrosion resistance of the composite material with a simultaneously oxide-free surface, 1 to 50 At.-%, preferably 6 to 30 At.-%, carbon (C) are embedded in an outer surface region of the tin coating up to a thickness D of approximately 2 $\mu$m. A method (oil treatment) and apparatus for the manufacture of the composite material of the invention are also disclosed.

14 Claims, 1 Drawing Sheet

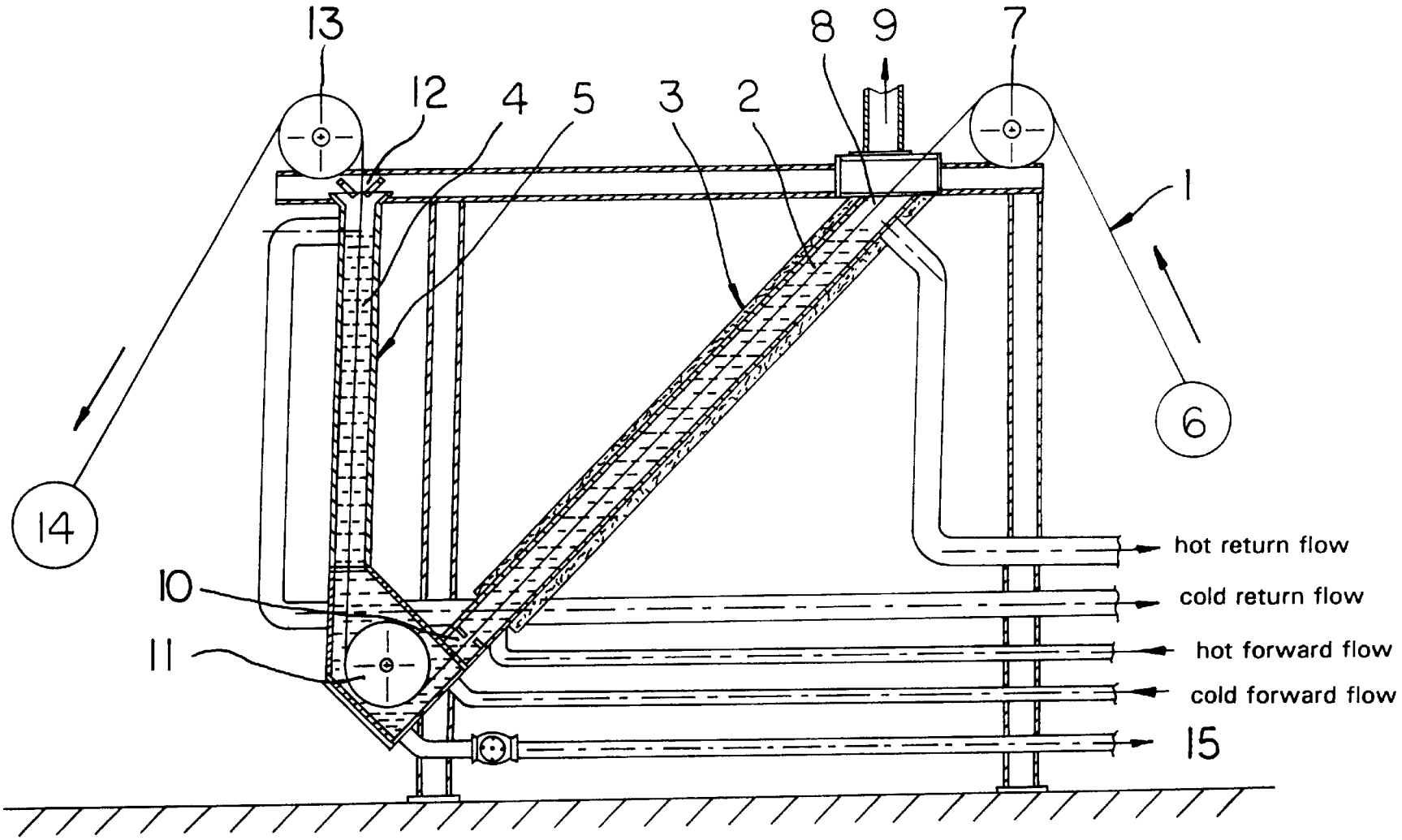
hot return flow
cold return flow
hot forward flow
cold forward flow
1
2
3
4
5
6
7
8
9
10
11
12
13
14
15

STRIP COMPOSITE MATERIAL AND A METHOD AND APPARATUS FOR ITS MANUFACTURE

FIELD OF THE INVENTION

The invention relates to an improved strip composite material with a base material of a metal or a metal alloy and with a surface coating of a pure tin or a tin alloy, wherein the surface coating is applied galvanically or by melt tinning and an intermetallic phase (IMP) is formed between the base and coating and a method and apparatus for its manufacture.

BACKGROUND OF THE INVENTION

A specific adjustment of the thickness of the intermetallic phase (IMP) occurs in hot-tinned strips through a subsequent heat treatment in hood-type, through-type, or suspended-conveyor furnaces at temperatures between 150° C. to 180° C. and annealing times, for example, in hood-type furnaces of about 16 h. In galvanically tinned strips, there takes place an additional reflow treatment with IR-radiation or hot air in order to achieve, through a remelting of the tin, a better solderability and/or a better adhesion of the tin on the base material. However, the surface is in both cases lightly oxidized or not protected against further oxidation so that a permanent low contact resistance, even under mechanical stress, is not guaranteed.

The basic purpose of the invention is to provide a strip composite material of the mentioned type with an oxide-free surface and which has a good wear and corrosion resistance.

SUMMARY OF THE INVENTION

This purpose is surprisingly attained by embedding 1 to 50 At.-% carbon (C), preferably 6 to 30 At.-% C, in an outer surface region of the tin coating up to a thickness D of approximately 2 $\mu$m (At.-%=atomic weight-%).

The embedding of carbon into the Sn layer results in an improvement in the friction behavior, namely, in plug connectors, in the reduction of the insertion and withdrawal force, in the improvement in the corrosion resistance, in particular the resistance to fretting corrosion, and thus in the guarantee of a constant contact transfer resistance during the life of, for example, plug connectors. The oil cannot be removed, for example, through an ultrasonic treatment in acetone. However, there exist no oxidic binding structures of the main elements.

The base material consists preferably of copper or a copper alloy, of iron or an iron alloy, of nickel or a nickel alloy, of zinc or a zinc alloy.

A method for the manufacture of the composite material of the invention is characterized in such a manner that the tinned base material is pulled through a hot oil bath for a duration of 1 min. to 130 min., which oil bath contains an oil of a paraffin and/or ester and/or fatty acid base, both of a natural and also synthetic origin, with common additives, and the temperature T of which the oil bath lies above the melting point of the respective tinning. The hot oil bath contains preferably a paraffin oil or paraffin-based solvent raffinates and is free of chlorine or PCB. The temperature lies above the melting point of the respective tinning: in the case of pure tin thus preferably at 240° C., in the case of SnPb at 200° C., in the case of SnAgO, 5Sb1 at 250° C. The duration is preferably 2 min. to 4 min.

The intermetallic phase (IMP) is adjusted depending on the layer thickness and temperature/time treatment to 10% to 100% of the entire tin layer thickness. The Sn surface shows then a high-gloss surface, which is, corrosion-resistant, in particular, however, fretting-corrosion-resistant. The static contact resistance does not change with the oil treatment. The friction forces are reduced through this by 20% to 75%.

It is furthermore advisable to quench the composite material immediately after the oil treatment in a cold oil bath of a paraffin and/or ester and/or fatty acid base, both of a natural and also synthetic origin, with the usual additives, at a temperature of 5° C. to 50° C., in particular at 20° C. to 30° C. The C content in the Sn layer is furthermore increased by this quenching. The duration of the composite material in the cold oil bath is preferably 2 min. to 10 min.

An apparatus for carrying out this modification of the invention is characterized by the apparatus having, in sequence, an unwinding device, a hot-oil part, a thermal lock, a cold-oil part and a winding-up device.

According to a further modification of the invention, oil of a paraffin and/or ester and/or fatty acid base, both of a natural and also synthetic origin, with the usual additives, is sprayed directly after the tinning of the base material onto the still hot tin coating. The oil is hereby not too tightly "bound" to the tinning, however, compared with the non-treated tinning, positive influences, in particular with respect to the fretting corrosion, can be measured.

BRIEF DESCRIPTION OF THE DRAWING

The single FIGURE shows a schematic of the sequence of the heat treatment of tinned strips in a hot oil bath followed by a cold oil quench.

DETAILED DESCRIPTION

The invention will be discussed in greater detail in connection with the following exemplary embodiment:

The FIGURE shows schematically the sequence of the heat treatment of tinned strips 1 in a hot oil 2 of a hot-oil part 3 with a subsequent quenching in cold oil 4 of a cold-oil part 5, whereby the strip 1 is guided cold from an unwinding device 6 (not illustrated in detail) through guide rollers 7 and a lock 8 into the hot oil bath 2 heated to 190° C. to 270° C. The oil-bath temperature must thereby lie above the melting point of the respective tinning. When the strip 1 is inductively brought up to temperature and moves then into the oil bath 2, there exists the danger of the formation of dewettings and of the "bone-shaped effect".

A smoke exhaust 9 is integrated at the highest point of the hot-oil part 3.

The strip 1 moves through a thermal lock 10 and around a guide roller 11 into a cooled oil bath 4 with a temperature of 5° C. to 50° C., preferably 10° C. to 30° C., for quenching without an air supply. When emerging from the oil bath 4, the excessive oil is wiped off by exhaust nozzles 12 or squeezing rollers, and the strip 1, guided by a guide roller 13, is wound up (onto a winding-up device 14 not illustrated in detail). The hot oil 2 is circulated by a circulation system having an integrated heating device. The cold oil 4 is circulated by a further circulation system having an integrated return-cooling device. The drain 15 is used only for servicing purposes.

Numerical Example:

A CuSn6-bronze strip with the dimension 0.63 mm×80 mm was hot-tinned with pure tin (layer thickness approximately 1.8 mm) and subsequently oil-treated in a bath of a commercially available, paraffin-based solvent raffinate (the respective treatment parameters are listed in Column I of the following table).

| I Treatment | II Layer Thickness RFA [μm] Coul (VS/RS) (VS/RS) | III C-content in At. % 0 → 2 μm Depth | IV Fretting Corrosion [mΩ/cycles] |
|---|---|---|---|
| Initial State | 1.5/1.7 1.1/1.5 | 0.7% → 0% | 1000/1250 |
| 195° C./1 min | 1.5/1.7 0.8/1.3 | 6% = 0.8% | 1000/2080 |
| 195° C./4 min A[1.)] | 1.5/1.8 0.8/0.7 | 1% = 0.6% | 1000/1850 |
| 250° C./4 min | 1.4/1.8 n.n[2.)]/0.2 | 10% = 0.1% | 3.8/5000 |
| 250° C./4 min | 1.4/1.8 n.n[2.)]/n.n.[2.)] | 25.8% = 0.1% | 2.6/5000 |

(A[1.)] = Quenching)
n.n[2.)] = Cannot be proven

Column II of the table lists the layer thickness on each of the front side (VS) and the back side (RS) of the strip. The layer thickness, which is measured by means of radiograph-fluorescence-analysis (RFA), is thereby the entire thickness of the free Sn layer and of the intermetallic phase (IMP), whereas the coulometrically measured layer thickness relates only to the free Sn layer. The difference thus results in the thickness of the IMP.

Column III of the table lists the C content, which is measured by means of auger-electron-spectroscopy (AES) and secondary-ion-mass-spectroscopy (sims).

Column IV of the table lists the fretting corrosion tendency, measured in accordance with the so-called "rider-on-flat" method (contact resistance in mΩ after n cycles at 1 N contact force and 25 μm amplitude). Either the number of cycles is thereby disclosed, after which a contact resistance of 1000 mΩ is reached, or —if 1000 mΩ is not reached—the measuring is stopped after 5000 cycles.

Using the table, it is stated that through an oil treatment at 195° C. compared with the initial state indeed a slight improvement with respect to the construction of the IMP and the fretting corrosion tendency is achieved, however, a significant shortening of the up to now common times for adjusting the IMP is achieved only through the oil treatment of the invention at 250° C. (a free Sn layer can no longer be detected according to Column II).

The fretting corrosion tendency is at the same time considerably reduced with an increasing carbon content.

The embodiments of the invention in which an exclusive property or privilege is claimed are defined as follows:

1. A strip composite material comprising a base material of a metal or a metal alloy, a surface coating of tin or a tin alloy, an intermetallic phase formed between the base material and the coating and 1–50 At. % carbon embedded in an outer edge section of the coating up to a thickness of approximately 2 μm, said coating being applied galvanically or by melt-tinning.

2. The strip composite material of claim 1, wherein 6–30 At. % carbon is embedded in the outer edge section.

3. The strip composite material of claim 1, wherein the base material is selected from the group consisting of copper, iron, nickel, zinc and alloys thereof.

4. A method of manufacturing a strip composite material comprising the steps of forming a coating of pure tin or a tin alloy on a base material of a metal or metal alloy galvanically or by melt-tinning such that an intermetallic phase is formed between the coating and the base material; and passing the coated base material through a hot oil bath so that the coated base material is immersed in the hot oil bath for 1–130 minutes to embed 1–50 At. % carbon in an outer edge surface section of the tin coating to a thickness of 2 μm, wherein the temperature of the oil bath is above the melting temperature of the coating and the oil bath comprises an oil of a paraffin, ester or fatty acid base.

5. The method of claim 4, wherein said oil bath consists essentially of at least one synthetic oil.

6. The method of claim 4, wherein said oil bath comprises an oil of an ester.

7. The method of claim 4, wherein said oil bath consists essentially of a paraffin-based solvent raffinate.

8. The method of claim 4, wherein the coated base material is quenched in a cold oil bath at a temperature of 5–50° C. immediately after being immersed in the hot oil bath, the cold oil bath comprising an oil of a paraffin, ester or fatty acid base.

9. The method of claim 8, wherein the quenching is at a temperature of 10–30° C.

10. The method of claim 8, wherein the coated base material is quenched for 2–10 minutes.

11. A method of manufacturing a strip composite material comprising the steps of forming a coating of pure tin or a tin alloy on a base material of a metal or a metal alloy galvanically or by melt tinning such that an intermetallic phase is formed between the coating and the base material and spraying an oil directly on the coating while its surface is still hot to embed 1–50 At. % carbon in an outer edge section of the coating up to a thickness of approximately 2 μm, wherein said oil comprises a paraffin, ester or fatty acid base.

12. The method of claim 11, wherein said oil consists essentially of at least one synthetic oil.

13. The method of claim 4, wherein said hot oil bath is at a temperature of from 190–270° C.

14. In a plug connector comprising male and female members which engage with each other, the improvement comprising said male and female members comprising a strip composite material having a base material of a metal or a metal alloy, a surface coating of tin or a tin alloy formed on the base material, an intermetallic phase formed between the base material and the coating and 1 to 50 At. % carbon embedded in an outer edge section of the coating up to a thickness of approximately 2 μm, said coating being applied galvanically or by melt-tinning.

* * * * *